United States Patent [19]

McMullen

[11] 4,233,763

[45] Nov. 18, 1980

[54] STEAM IRON WITH LOW TEMPERATURE SOLEPLATE

[75] Inventor: Alan R. McMullen, North Canton, Ohio

[73] Assignee: NESCO Products, Inc., Binghampton, N.Y.

[21] Appl. No.: 935,294

[22] Filed: Aug. 21, 1978

Related U.S. Application Data

[63] Continuation of Ser. No. 658,266, Feb. 17, 1976, abandoned.

[51] Int. Cl.[2] ..... D06F 75/06; D06F 75/38

[52] U.S. Cl. ..... 38/77.83; 38/93

[58] Field of Search ..... 38/77.83, 77.5, 77.7, 38/77.8, 88, 90, 93

[56] References Cited

U.S. PATENT DOCUMENTS

| | | | |
|---|---|---|---|
| 2,708,801 | 5/1955 | Voskresenski | 38/77.83 |
| 3,480,461 | 11/1969 | Lynge | 38/93 |
| 3,675,351 | 7/1972 | Downing | 38/77.83 |
| 3,986,282 | 10/1976 | Nelson | 38/77.83 |

*Primary Examiner*—Patrick D. Lawson

*Attorney, Agent, or Firm*—Sughrue, Rothwell, Mion, Zinn and Macpeak

[57] ABSTRACT

The present invention is directed to a lightweight portable steam iron utilizing an internal heated mass of sufficiently high temperature during operation to assure the generation of steam and having a plastic pressing surface which is heated by the aforementioned internal mass yet sufficiently insulated therefrom to maintain a relatively cool temperature in relationship to the internal mass. In the preferred form steam iron has a preset temperature control means which maintains the above mentioned temperature relationships during operation of the iron. Preferably the exterior surfaces of the iron are all plastic and the soleplate is maintained at a lower temperature than heretofore common in steam irons during a steaming operation. The iron also contains a steam valve which is operated from the handle in such a manner that it is always open when the iron is in use.

6 Claims, 10 Drawing Figures

FIG. 1
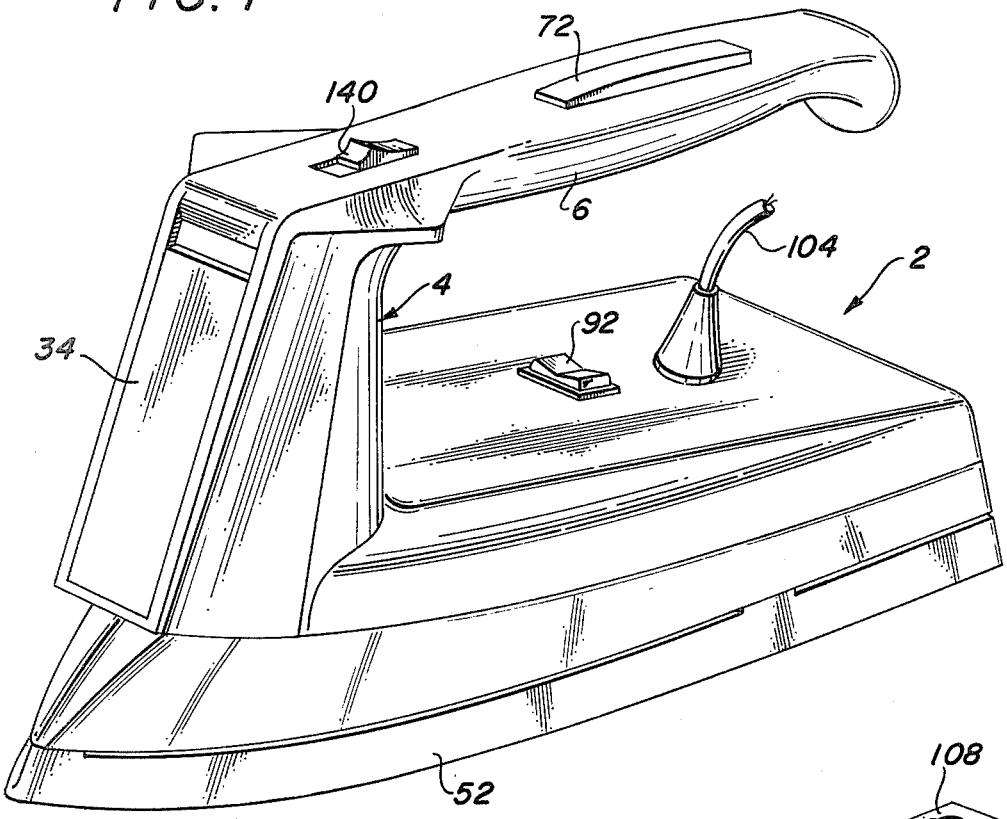
FIG. 8
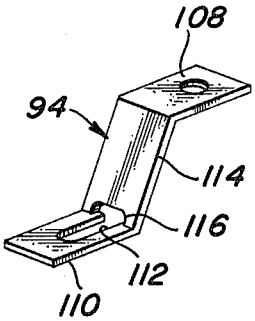
FIG. 7
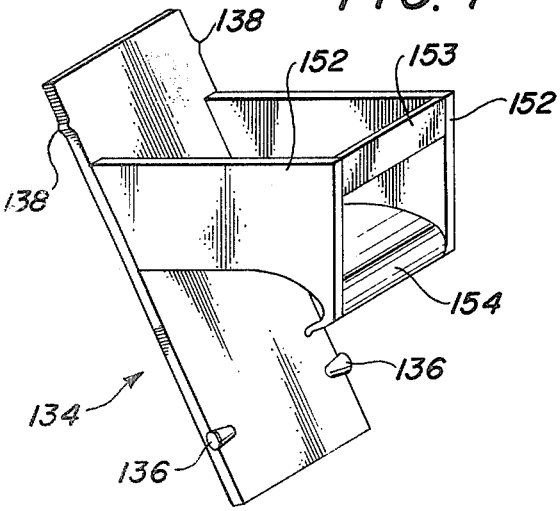
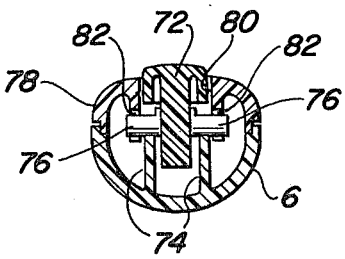
FIG. 6

FIG. 3
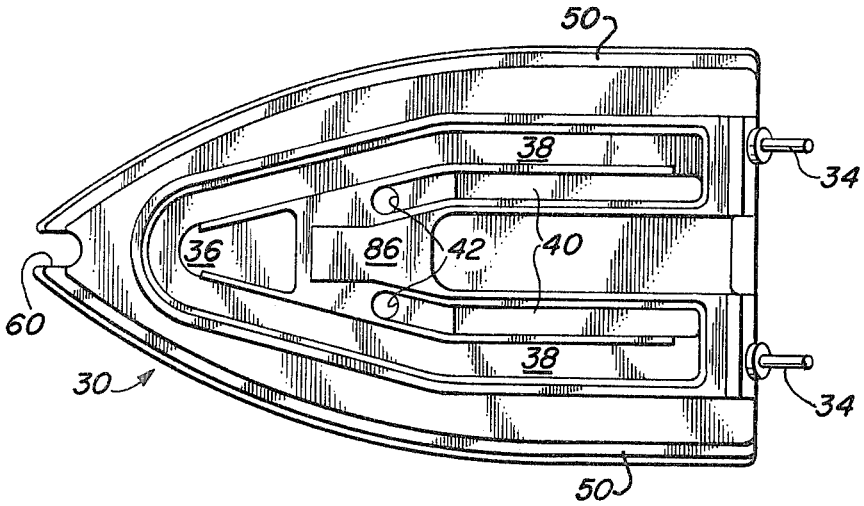
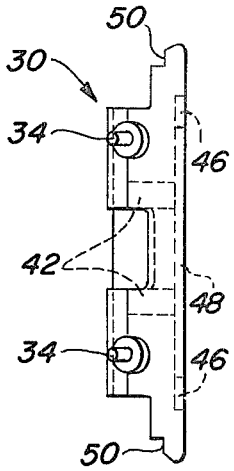
FIG. 3A
FIG. 4
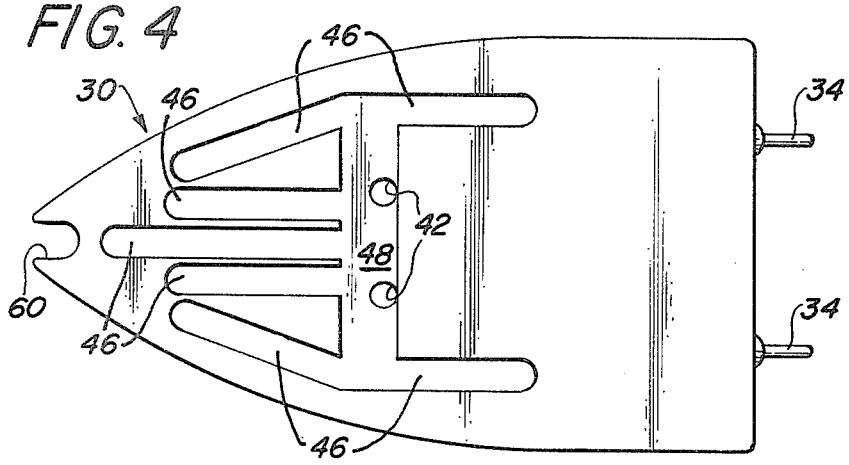
FIG. 5A
FIG. 5
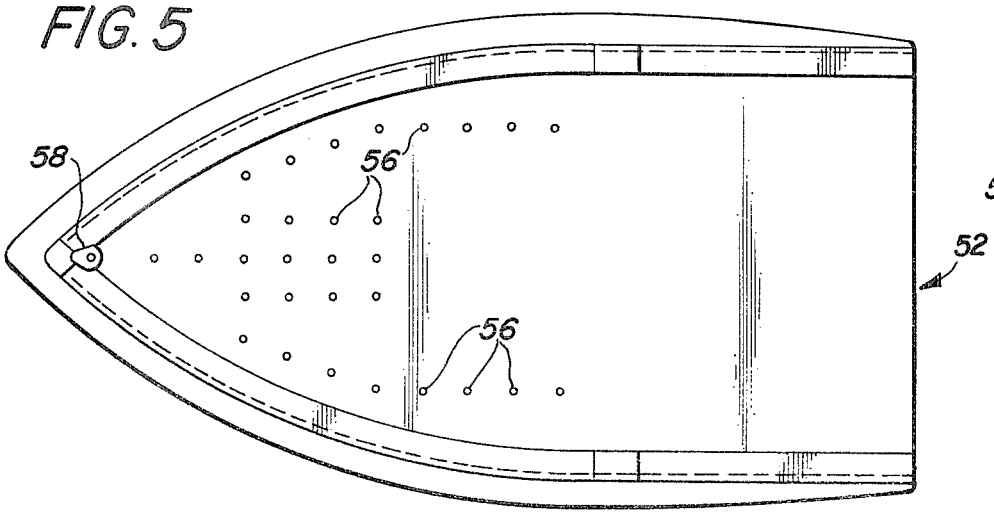
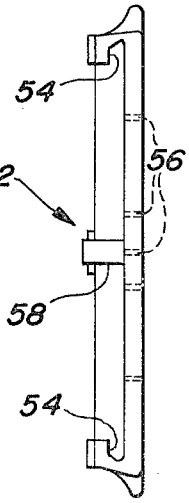

STEAM IRON WITH LOW TEMPERATURE SOLEPLATE

This is a continuation of application Ser. No. 658,266, filed Feb. 17, 1976, now abandoned.

BACKGROUND OF THE INVENTION

The present invention relates to a steam iron having a low temperature pressing surface. The common steam iron of today's market utilizes an aluminum soleplate which provides the pressing surface and also includes a boiler, generally of the flash boiler type. It is necessary to heat this aluminum mass to a sufficiently high temperature, generally over 300° F., when the iron is used as a steam iron in order to assure that the water that enters the flash boiler reaches a sufficiently high temperature to be turned into steam and maintain this state so that it does not leave the iron in water droplets and thus water stain the clothes. The pressing surface which is also a part of this aluminum mass is thus maintained at a relatively high temperature which would be damaging to the low temperature fabrics of today's market. Therefore, in irons of this type steam ironing of low temperature fabrics is not possible and thus the iron must be used as a dry iron when low temperature fabrics are ironed.

Prior art has also attempted to solve this problem by utilizing a plastic add-on shoe disposed beneath the plate of the iron. Such shoes, however, have not found general acceptance. Furthermore, the irons upon which they are used are not designed with this intent in mind and thus are not calibrated with respect thereto thus making the temperature settings for use with the shoe purely guesswork.

SUMMARY OF THE INVENTION

The present invention is directed to a new improved steam iron which utilizes a heated mass containing a flash boiler therein for the generation of dry steam at a desired rate and a separate plastic soleplate which is in heat transfer relationship to the heated mass. A thermostat is used which senses the temperature of the heated mass and is calibrated to insure that the heated mass maintains sufficient temperature to guarantee flash boiling of the water in the boiler chamber and while maintaining the plastic soleplate at a temperature sufficient for ironing but a sufficiently low enough temperature so as to prevent damage to the plastic soleplate. Thus the heat transfer relationship between the heated mass and the plastic soleplate is designed in conjunction with a calibrated thermostat to guarantee that: (1) the aluminum mass is maintained at a sufficiently high enough temperature to maintain flash boiler and (2) the plastic soleplate is maintained at a high enough temperature to provide satisfactory ironing results but at a low enough temperature to prevent damage to the soleplate. This latter feature also provides an iron which is generally safer to use in that all external parts of the iron, including the soleplate, are electrically insulated and, furthermore, are maintained at a relatively low temperature, compared to previous irons, and thus, help prevent high temperature burns.

Another aspect of the present invention is that the present iron is always utilized as a steam iron in order to provide satisfactory operation thereof and, thus, the water valve is designed to be maintained in an open position when the iron is in use.

A further aspect of the present invention is a simplified and attractive filling means for supplying water to the water tank of the iron. A still further aspect of the present invention is an iron which is simply and easily assembled with a minimum of externally exposed fastening means.

BRIEF DESCRIPTION OF THE DRAWINGS

The invention, together with its construction and method of operation, and along with other objects and advantages thereof is illustrated more or less diagrammatically in the drawings in which;

FIG. 1 is a perspective view of the steam iron which provides the embodiment of the present invention;

FIG. 3 is a top plan view of the heated mass of the iron;

FIG. 3*a* is an end view of the heated mass;

FIG. 4 is the bottom plan view of the heated mass;

FIG. 5 is a top plan view of the soleplate of the iron;

FIG. 6 is a cross-sectional view of the handle of the iron taken along lines 6—6 of FIG. 2;

FIG. 7 is a perspective view of the front door and fill means of the iron; and FIG. 8 is a perspective view of an assembly part of the iron innerconnecting the main body portion and the soleplate.

BRIEF DESCRIPTION OF THE PREFERRED EMBODIMENT

Figure 2:
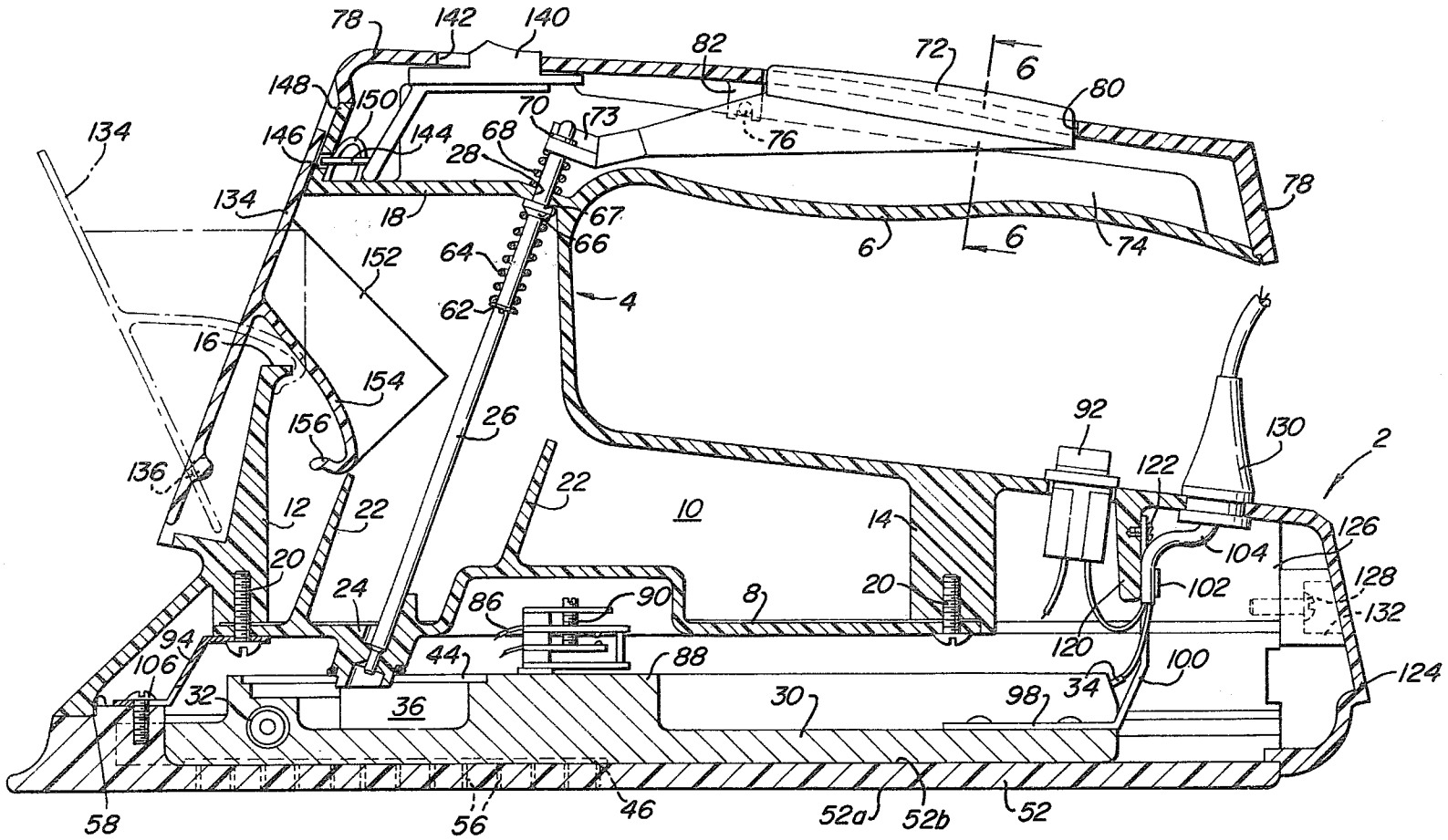
FIG. 2 is a side elevational view in cross-section taken along the longitudinal axis of the iron.

Referring now to the drawings, FIGS. 1 and 2 teach a steam iron 2 which is the preferred form of the present invention. The iron 2 has a plastic main body portion 4 which defines the lower portion 6 of the handle and cooperates with a cover plate 8 to form a water tank 10. The water tank 10 is primarily defined by the main body portion including side skirts, a front upstanding wall 12, a rearward depending wall 14. A fill opening 16 is located in the main body portion 4 above the front wall 12 below a top wall 18. The water tank 10 is further defined by the cover plate 8 which is secured to the main body portion 4 by a plurality of screws 20. The cover plate 8 is provided with several baffles 22 which prevent excessive fore and aft movement of the water in the tank 10 when the iron 2 is in operation. The baffles 22 do not extend the full width of the main body portion 4 to provide a gap between the baffles 22 and the side walls or skirt which allows water to flow around the baffles 22 so that all the water may be drained through a valve seat 24 also formed in the cover plate 8. A valve stem 26 is located to operate within the valve seat 24 and, furthermore, extends upwardly through an opening 28 in the top wall 18. The operation of the valve shall be described later.

The heated portion of the iron 2 is a heated aluminum mass 30 shown in cross-section FIG. 2 and shown in detail in FIGS. 3, 3*a* and 4. The heated mass 30 has an electric heating element 32 which includes a forward bight portion and terminating in terminal pins 34 at the rear of the heated mass 30. The top surface of the heated portion 30 is provided with a flash boiler 36 which is located directly beneath the valve seat 24 of the cover plate 8 when the heated mass 30 is properly positioned within the iron 2. The steam after being generated in the flash boiler 34 proceeds rearwardly along outboard steam passages 38 which directly overlie the heating element 32. The steam then progresses forwardly through the inboard steam passages 40 and, thence, through the heated mass by means of bores 42. A plate 44 overlies the flash boiler 34 and the passages 38 and 40 to prevent the escapement of steam therefrom. The bottom side of the heated mass is taught in FIG. 4 and has a plurality of shallow grooves 46 which are interconnected with the bores 42 by means of a transverse groove 48. The grooves 46 act as steam distribution passageways.

The heated mass 30 has a peripheral flange 50 which allows the heated mass 30 to be slid into the rear of the soleplate 52 so as to be trapped on the soleplate 52 by means of a peripheral channel 54 formed on the soleplate 52 as shown in FIGS. 5 and 5*a*. The soleplate 52 is provided with a plurality of steam vents 56 passing therethrough which allow the steam from the distribution grooves 46 to pass through the soleplate 52 and on to the clothes being ironed. The soleplate 52 furthermore has an upwardly extending boss 58 which is received by the bifurcated forward portion 60 of the heated mass 30 when the mass 30 is shoved to the forward portion of the soleplate 52.

The soleplate 52 is preferably formed of a relatively high temperature thermal plastic such as polysulfone, polyphenylene sulfide or glass filled polyester. Such a high temperature plastic is desirable since in the preferred form the heated aluminum mass 30 is in direct thermal contact therewith. An asbestos sheet (not shown) could be inserted between the mass 30 and the soleplate 52, but the use of the asbestos sheet to reduce heat transfer has not been found necessary. Such asbestos sheet, however, must have openings therein to allow the passage of steam from the grooves 46 to the steam vents 56.

To control the water flow from the tank 10 to the steam boiler 34, the previously mentioned valve stem 26 seats in the valve seat 24 which provides a passageway from the tank 10 to the boiler 34. The valve seat 24 is formed integrally with the upper plate 8 of the water tank and is received in an opening of the plate 44 which covers the boiler 34 and is sealed with respect thereto. Since the valve seat 24 is in such close proximity to the steam boiler and since the cover plate 8 directly overlies the heated mass 30, the cover plate 8 is preferably made of a high temperature thermal plastic such as polysulfone.

The valve stem 26 is provided with a washer 62 which rests on a struck-out portion of the valve stem 26, a spring 64, and a cupped washer 66 and silicone rubber seal 77 combination. The upper end of the valve stem 26 is then inserted through opening 28 in the top wall 18 of the main body portion 4 with the top end of seal 67 abutting the bottom side of top wall 18. A spring 68 is then inserted over the top end of the valve stem 26 by a clip or other means.

A steam lever 72 has a forward portion which forms a bifurcated cup 73. The bifurcation portion of the cup 73 is inserted around the valve stem 26 and between the spring 68 and washer 70 so as to be trapped therebetween, the upwardly extending cup surrounding the washer 70 on three sides. The lower handle portion 6 formed integrally with the main body 4 has two ribs 74 which extend the length of the handle portion 6 and also over the top wall 18. These ribs 74 are shown in both FIGS. 2 and 6. The steam lever 72 has integrally formed thereon two pins 76 which rest on the ribs 74 as seen in FIG. 6. A top handle portion 78 is provided with a slot 80 which accepts the upper portion of the steam lever 72. The top handle portion 78 is furthermore provided with two downwardly extending bifurcated extensions 82 which receive the pins 76, one on each side of the steam lever 72. These bifurcated extensions 82 combine with the ribs 74 to trap the pins 76 as shown in FIGS. 2 and 6. This both locates and provides a pivot point for the steam lever 72. The top handle portion may now be glued or otherwise secured to the main body portion 4 to provide a handle with the lower handle portion 6.

The spring 64 on the valve stem 26 is stronger than the spring 68 and, thus, biases the valve stem 26 into the seated or closed position within valve seat 24. The spring 68 maintains a bifurcated cup 73 in engagement with the washer 70. Whenever a hand is placed on the handle of the iron during operation thereof, the weight and grasp of the hand will automatically depress the top portion of the steam lever 72 which causes it to pivot on pins 76 and thus raise the valve stem 26 via the washer 70. Thus, during operation of the iron the valve stem 26 is removed from the valve seat 24 and water may flow from the tank 10 to the steam boiler 34 thus causing a steaming operation. A water window, optional and not shown, can be provided on the main body portion to allow the user to be aware of the water contents within the tank 10.

To control the temperature of the iron, a thermostat 86 of the conventional stack pole type is located on a raised boss 88 of the heated mass 30 directly behind the flash boiler 34 and within the bight of the heating element 32. The thermostate 86 in this position is able to sense the temperature of the heated mass 30 near the boiler 34 which is where the temperature of the iron fluctuates the most. Sensing of the soleplate 52 would be less desirable due to the lesser temperature fluctuation and the time lag involved. Since there is a definite correlation between the temperature of the mass 30 and the temperature of the soleplate 52, the thermostat sensing the heated mass 30 is able to accurately and quickly control the temperature of both elements. This thermostat 86 could be manually controlled as in a normal steam iron, but its temperature range must be rather limited as explained later. It has been found, however, sufficient and desirable that the thermostat in the iron in the present invention have a single set temperature, preset at the factory by means of a set screw 90. This is sufficient for operation of the iron and eliminates need for complicated and costly adjustments arrangements found in most irons. If such a preset thermostat is used, an on/off switch 92 may be provided.

To assembly the iron 2, the valve stem 26, steam lever 72, and handle 6 are assembled as previously described. A sealant is applied to the cover plate 8 which is then located over the valve stem 26 so as to seat the valve stem 26 within the valve seat 24. The cover plate 8 is then fastened to the body portion 4 by means of the screws 20. At this time, the forward screw 20 is utilized to connect the forward locating plate 94, shown in FIG. 2 and in detail in FIG. 8, to the handle assembly. The heated mass 30 is then slid into the rear of soleplate 52 and trapped thereon by the peripheral flange 54 as previously described. A rearward locating plate 98 is fastened to the mass 30 and has an upwardly extending bifurcated portion 100 with a transverse bar 102. The thermostat 86 is mounted on the mass 30 and electrically innerconnected with the switch 92 previously mounted on the main body portion 4 and one of the heater terminal pins 34. The power cord 104 is passed in front of the transverse bar 102 and electrically innerconnected with the switch 92 and the other terminal pin 34.

A screw 106 is fastened to the forward boss 58 of the soleplate 52 with the head of the screw 106 slightly spaced above the boss 58. The forward locating plate 94, shown in FIG. 8 and previously fastened to the main body portion at the bifurcated area 108, has a lower portion 110 having a rearwardly facing slot 112. The upwardly extending portion 114 innerconnecting the lower portion 110 with the upper portion 108 has an opening 116 aligned with the slot 112 and of sufficient size to allow the head of screw 106 to pass therethrough. The forward portion of the body 4 with the plate 94 attached is pointed downwardly and brought in the proximity slightly forward of the screw 106 fastened to the soleplate 52. The handle is now pulled rearwardly allowing the head of the screw 106 to pass through the slot 116 and the shank of the screw 106 pass into slot 112, and thus trap the forward locating plate 94 to the soleplate 52 by means of the screw 106.

The rear of the main body portion is now brought downwardly so that the downward depending flange 120 thereof is brought in close proximity to the bifurcated portion 100 of the rearward locating plate 98 trapping the power cord 104 between the transverse bar 102 and the downward depending flange 120. Screws 122 are then utilized to fasten the bifurcated portion 100 to the flange 120 and thus lock the mass 30 with entrapped soleplate 52 to the main body portion of the iron.

A rear cover plate 124 is then connected to two parallel axially extending ribs 126 of the main body portion 4 by means of screws 128, at the same time trapping the power cord strain relief 130 between the rear plate 124 and the main body portion. The screws 128 are located within recesses 132 to keep the metal screws 128 from being readily exposed. Since the main body portion 4, rear cover plate 124 and the handle's top portion 78 are formed of plastic there is no exposed metal part except the heads of screws 128 which are in recesses.

Another feature of the steam iron 2 shown in the drawings is simplified fill means formed by the door 134 shown in FIG. 2 and in detail in FIG. 7. The door 134 closes off the front end of the iron 2 and particularly the fill opening 16 to provide a pleasing appearance. The lower portion of the door 134 is provided with two hinge pins 136 which snap into recesses on each side of the forward portion of the main body portion 4 and thus provide a pivot point point for the door 134. The door 134 is also provided with protuberances 138 which cooperate with the main body portion 4 to provide a detent or frictional latch for the door 134 to hold it in the closed position. To facilitate opening the door 134, the iron handle is provided with a sliding button 140 which rests on the ribs 74 of the lower handle portion 6 and also protrudes to an opening 142 in the top handle portion 78. The sliding button 140 is provided with a forwardly extending pin 144 which extends through an opening 146 in the upwardly extending portion 148 of the main body portion 4 located above the top wall 18. A spring 150 is located between the wall 148 and the sliding button 140 to bias the button rearwardly. Manual movement in the forward direction of the button 140 causes the pin 144 to engage the back of the door 134 to overcome the frictional latch and thus open the door.

Molded integrally with the door 134 is a funnel comprising of side walls 152, strengthening rib 153 and a bottom wall 154. The bottom wall 154 slopes downwardly and at its free end is provided with a hooked edge 156 which engages the top edge of the front wall 12 of the main body portion 4 to limit forward motion of the door 134. The door and funnel when in their forward position provide a fill means for the tank 10 and allows the iron 2 to be filled while resting with its soleplate on a horizontal surface.

The iron as described above utilizes a heated mass 30 which is separate from the soleplate 52. The mass 30 which is preferably of aluminum includes the boiler 34 and must be kept at a sufficient temperature to convert water introduced into the boiler 34 into steam. At the same time, heat is transmitted from the mass 30 through soleplate 52 to the pressing surface 52A on the bottom thereof. The pressing surface 52A must be maintained at a sufficiently high enough temperature to prevent condensation of the steam which passes through the vents 56. Thus, the pressing surface should reach a minimum temperature of about 212° F., the boiling point of water. Since the soleplate 52 is a plastic, even though a high temperature thermal-plastic, there is a maximum temperature which it can stand without melting or damage thereto. For polysulfone this is around 340° F. Thus, there is a temperature relationship between the heated mass 30 and the soleplate 52 which must be maintained. The mass 30 should be kept below 340° F. in order to prevent damage to the top surface 52B of the soleplate 52. This temperature, however, could be raised if an asbestos shield is placed between the mass 30 and the top surface 52B of soleplate 52. The bottom 52A of the soleplate 52 should be maintained at about 212° F. or above to prevent condensation of the steam passing through the vents 56.

In practice, it has been found that a temperature setting of 300° F. preset on the thermostat 86 which senses the temperature of the mass 30 keeps the boiler 34 sufficiently hot to generate steam at approximately 10 to 12 grams per minute, while at the same time maintains a pressing surface temperature of around 250° F. without damage to the soleplate 52. If a manually adjustable thermostat were to be used, it would have to have a very limited range in order to assure that the pressing surface was kept above 212° F. at low range but yet the top part of the soleplate 52 did not reach a damage point when the thermostat was set at a maximum temperature.

In designing the iron it has also been found desirable to have the steam channels 38 on the top surface of the heated mass 30 to run substantially the length of the heating element 32. This not only allows the steam to be further heated after leaving the flash boiler 34 but tends to equalize the temperatures along the length of the mass 30 and prevents spot overheating. This is extremely desirable due to the critical temperature relationship between the mass 30 and the plastic soleplate 52 as mentioned above.

Due to the relatively low temperature of the soleplate 52, it has been found necessary to utilize the iron as a steam iron rather than a dry iron in order to iron a wider range of fabrics. The steam rate of 6 grams per minute appears to be the minimum steam rate sufficient to provide a satisfactory result. A steam rate of 10 to 12 grams a minute appears to provide more satisfactory results while even higher steam rates would appear possible as long as the mass 30 is kept hot enough to adequately convert the water to steam but yet not hot enough to melt the plastic soleplate. This temperature, of course, is dependent upon the type of plastic used in the soleplate.

It is for this reason that the steam lever arrangement described above is utilized to provide water flow and thus steam generation when the iron is used.

The utilization of the plastic soleplate has been found to provide several advantages. The thickness of the soleplate 52 provides a thermal barrier between the heated mass 30 and the pressing surface and thus allows the mass 30 to be relatively high temperatured to guarantee the sufficient generation of steam and at the same time allow the pressing surface to be at a relatively low temperature so that delicate fabrics are not destroyed. It has been found that a plastic pressing surface does less damage to low temperature fabrics than a metal pressing surface even when the plastic pressing surface is at a higher temperature. Furthermore, the plastic surface when compared to a metal pressing surface, has been found to reduce the tendency of the cloth to glaze during an ironing operation.

The iron 2 with a plastic soleplate 52 also appears to reduce the hazards during ironing. The plastic, of course, is a dielectric and thus the pressing surface would not become electrically "hot" if an electric failure were to occur within the iron. Thus, the plastic soleplate, especially when used in conjunction with the plastic handle, reduces electrical shock hazard upon malfunction. Furthermore, plastic has a lower apparent thermal conductivity than metal when in contact with skin. Thus, equal time exposure of the skin in contact with a heated plastic surface will cause less heat transfer and thus less of a burn than contact with metal, even though the plastic and metal are at the same temperature. This fact, along with the relatively low temperature of the pressing surface, reduces the thermal hazard of accidental contact with the soleplate 52. Even when the pressing surface is at about 250° F., it has been found that momentary contact does not produce as severe a burn as would be generated by momentary contact with the soleplate of the standard steam iron which has both a metal surface and a considerably hotter surface during steaming.

A heel rest is not needed with the present iron since the soleplate temperature is around 250° F. which safely allows the iron 2 to rest on an ironing board even when "ON". A heel rest, however, can be provided by the rear cover plate 124 and the rear end of handle top portion 78.

It is, therefore, felt that an iron of the present invention can provide a construction which is lightweight, easier to assembly, comparatively safe in operation, and allows for steam ironing of fabrics of a delicate nature.

I claim:

1. A steam iron comprising a handle, a water tank, a heated metal mass including a boiler in fluid communication with said tank, an electrical circuit including a heater for said heated mass, a valve controlling water flow from said tank to said boiler, the improvement comprising:

a plastic soleplate in heat transfer relationship with said heated metal mass and having a pressure surface on its underside, a thermostat within said electrical circuit for controlling the heat input to said heated metal mass by controlling energization of said heater, said thermostat being provided with minimum and maximum temperature settings correlated to the thermal conductivity, the melting temperature, the thickness of said plastic soleplate and the heat transfer relationship between said heated metal mass and said soleplate, and said plastic soleplate being of sufficient thickness; such that at the minimum temperature setting said heated mass is maintained at a temperature sufficiently high to boil water entering said boiler, and said pressing surface is maintained at a temperature above the condensation point of steam, and at the maximum temperature setting, the temperature is sufficiently low to prevent damage to said plastic soleplate adjacent said heated metal mass, and said pressing surface of said plastic soleplate is maintained at a temperature below that which would damage low temperature fabrics.

2. The steam iron of claim 1 wherein a single preset thermostat setting provides both said minimum and said maximum temperature settings.

3. The steam iron of claim 1 wherein said thermostat is mounted on said heated mass to maintain the temperature thereof.

4. The steam iron of claim 3 wherein said thermostat mounted on said heated mass is located adjacent said boiler.

5. The steam iron of claim 1 having water valve operating means mounted on said handle and adapted to be operated upon a normal grasping of said handle by a user whereby said water valve is open during operation of said iron.

6. The steam iron of claim 5 wherein said water valve allows a water flow from said tank to said boiler of 10 to 12 grams per minute when said valve is open.

* * * * *